United States Patent [19]

Eickmann

[11] Patent Number: 4,479,420

[45] Date of Patent: Oct. 30, 1984

[54] ANTI FRICTION MEANS IN PIVOT MEANS PREFERABLY IN RADIAL PISTON PUMPS, MOTORS OR TRANSMISSIONS

[76] Inventor: Karl Eickmann, 2420 Isshiki, Hayama-machi, Kanagawa-ken, Japan

[21] Appl. No.: 348,105

[22] Filed: Feb. 11, 1982

Related U.S. Application Data

[63] Continuation-in-part of Ser. No. 121,356, Feb. 14, 1980, , said Ser. No. 121,356, is a continuation of Ser. No. 790,822, Apr. 25, 1977, abandoned.

[51] Int. Cl.[3] ..... F01B 31/10

[52] U.S. Cl. ..... 92/159; 91/488

[58] Field of Search ..... 92/158, 159, 160, DIG. 1, 92/DIG. 2; 91/488

[56] References Cited

U.S. PATENT DOCUMENTS

| | | | |
|---|---|---|---|
| 3,106,138 | 10/1963 | Thoma | 91/488 |
| 3,223,046 | 12/1965 | Eickmann | 91/488 |
| 3,395,948 | 8/1968 | Andrews | 91/488 |
| 3,960,057 | 6/1976 | Komentani et al. | 92/160 |

FOREIGN PATENT DOCUMENTS

| | | | |
|---|---|---|---|
| 2460512 | 6/1976 | Fed. Rep. of Germany | 92/158 |
| 574041 | 3/1976 | Switzerland | 92/158 |
| 983310 | 2/1965 | United Kingdom | 91/488 |

*Primary Examiner*—Paul E. Maslousky

[57] ABSTRACT

A cylindrical piston has a part-cylindrical outcut, which is slotted radially and contains a swingable pivot-member of at least part-cylindrical configuration borne in the outcut and pivoting therein under load. The mentioned outcut is formed partially around an axis which is normal to the longitudinal axis of the mentioned piston and extending through the longitudinal axis of the piston. A plurality of preferably part-annullarily formed grooves for the reception of pressure fluid are provided preferably in said pivot-member in order to lubricate bearing portions of said member between two adjacent grooves or recesses to assure a high pressure lubrication from both ends of the respective bearing portion. Efficiency and lifetime of said bearing portion is thereby increased and so is the bearing capability.

16 Claims, 28 Drawing Figures

PRIOR ART

ANTI FRICTION MEANS IN PIVOT MEANS PREFERABLY IN RADIAL PISTON PUMPS, MOTORS OR TRANSMISSIONS

REFERENCE TO RELATED APPLICATION

This is a continuation in part application of my co-pending patent application Ser. No. 06/121,356, which was filed on Feb. 14, 1980. The said application will become issued as U.S. patent in the near future. Application 121,356 is a continuation application of my earlier application Ser. No. 05/790,822 which was filed on Apr. 25th, 1977 and which is now abandoned. Priority of Apr. 25, 1977 of Ser. No. 05/790,822 is claimed for this present continuation in part application.

DESCRIPTION OF AND REFERENCE TO FORMER ART

Certain pistons and piston shoes in radial piston devices, such as pumps, motors, compressors, transmissions which are characterized therein, that the piston has a radially outwardly or inwardly slotted bore and a pivot-bar portion of part-cylindrical configuration pivotably or swingably borne therein. Said pivot-bar portion is a portion of a piston shoe, which is inserted between said piston and an actuator means to actuate the piston stroke. The slot of said bore is narrower than the diameter of said bore. The piston shoe has an outer portion and a medial portion between said outer portion and said pivot bar portion. The said medial portion is narrower than said slot of said slotted bore. Thereby it is assured, that the piston shoe can pivot in a limited extend with its pivot-bar portion in said slotted bore and thereby the piston shoe can pivot relatively to said piston. Parts of the walls of the slotted bore embrace neighbouring portions of the pivot-bar portion in the preferred known art and thereby the piston shoe is fastened to the piston. In other samples the piston shoe may just be laid onto the piston without embracement of portions thereof on each other. Those piston-piston-shoe assemblies are known from my basic U.S. Pat. No. 3,223,046 and so also from improvement patents, like U.S. Pat. Nos. 3,225,706; 3,304,883 or others.

In the mentioned former art it is also already disclosed, that recesses are provided between the pivot-portion and the piston and passages lead to said recesses in order to force-lubricate the bearing of said pivot-bar portion in said piston.

REFERENCE TO CO-PENDING APPLICATION

A very considerable improvement of the mentioned art is obtained in my earlier co-pending U.S. patent application Ser. No. 528,346 of Nov. 29th, 1974, which was also present in at that time co-pending application Ser. No. 765,221 of Feb. 3rd, 1977; namely in FIGS. 19 and 22 thereof. In these and other similar patent applications in USA and other countries, the pivot-bar portion has rounded ends parallel to the outer diameter of the piston and the sealing portions of the pivot-bar portion outwards of the fluid pressure pocket have about equal extension whereby a maximum of cross-sectional area of said fluid pressure pocket or lubrication recess is obtained. Earlier applications 528,346 and 765,221 are now U.S. Pat. Nos. 4,193,336 and 4,206,690.

BACKGROUND OF THE INVENTION

The above mentioned former art has operated for more than a decade from its origin with high reliability and performance. I have found however, that the efficiencies can be further improved and thereby the life time can be elongated and the pressure and rotary velocity in machines which employ the pivot-portion of a piston shoe in a slotted bore of a piston can still further be improved. I have also found, that such improvement is necessary in order to apply such machines for ever higher pressures, powers and velocities in from time to time advancing applications with requirements to higher power and efficiency; like aircraft, vehicles, construction machinery, machine tools and like.

SUMMARY OF THE INVENTION

It has been found, that the above mentioned former art applies practically a single fluid pressure pocket between the bearing faces of the pivot-bar portion and the piston. The used fluid pressure pocket provides an effective lubrication and also a very considerable reduction of the relative load between the piston and pivot bar portion, because the forces of pressure in fluid in the balancing recess or fluid pressure pocket acts in opposite direction against the piston and the pivot-bar portion, whereby it trends to press them away from each other. Thereby reducing the load of the piston onto the piston-shoe. This reduction of load is as higher as bigger the cross-sectional area of the fluid pressure pocket is.

It has now been found in accordance with this invention, that the cross-sectional area of the said fluid pressure pocket can not be extended unlimited. A sealing portion must remain on each end of the fluid pressure pocket. If this sealing portion becomes too thin or too short, the relative load on the sealing portions becomes so high, that the sealing portions deform.

It has further been found in accordance with this invention, that high power devices need a relatively large piston stroke per given diameter of the device, which in turn requires a relatively wide pivoting angle. This wider pivot-angle results in a relatively high relative velocity between the neighbouring bearing faces and thereby in the sum in a high friction between the pivot-bar member and the wall of the slotted bore in the piston.

Certainly this matter has been given some attention in the earlier patents of applicant. However, the disastrous effect of the said friction at high velocities and pressure has never been found out in its entire extent.

New researches in the matter have now in accordance with this invention discovered, that the said friction can become very high at big pivot-angles, velocities and pressures.

Also by this invention one of the reasons of said friction has been further discovered. This is, that in the seal portions between the sealing faces a pressure gradient appears. Such pressure gradients from high pressure down to sorrounding low pressure are generally known. However in the case of the narrow seal portions between pivot bar portion and piston's slotted bore-wall, the forces, which press the piston and pivot-bar together are so high, that almost no fluid pressure enters into the seal portion between the sealing faces. That results in an almost dry friction and wear off of the seal faces.

Since this fact is now discovered by this invention, the means to overcome this drawback are also discovered in this invention.

It is therefore the main object of this invention to prevent extensive dry friction between the seal portions and at the same time to provide a larger bearing face area between piston shoe-pivot bar and the piston's cross-bore wall.

Another object of the invention is to provide fully pressure lubricated bearing face portions between pivot-bar portion and The objects of the invention are materialized by the provision of a plurality of narrow recesses and fluid pressure passages to them between the said walls and portions in order to establish a plurality of bearing face portions, which are lubricated under force from both ends and which bear the pivot-bar portion on the wall of the slotted bore in the piston, whereby they eliminate too narrow a clearance in the sealing end portions and at the same time narrow the bearing load in the sealing portions on the ends of the pivot-bar portion.

The provisions of this invention narrow the relative load on the bearing faces and sealing faces between the pivot-portion of the piston shoe and the piston very extensively and thereby provide a high efficiency at pivot move and extend the life time of the piston and piston shoe very considerably. Thereby in turn the efficiency and life time of the pump, motor, compressor, transmission or pivot-bearing becomes increased in a surprisingly high degree.

The term "pivotion" defines in this application a pivotal movement. The term "pivotion" is under this definition used since 1982 in the U.S. patent literature.

The term "at least" means in this specification and in the claims one or more than one. The term "at least two" defines in this specification and claims two or more than two.

DESCRIPTION OF THE PREFERRED EMBODIMENTS

Figure 1:
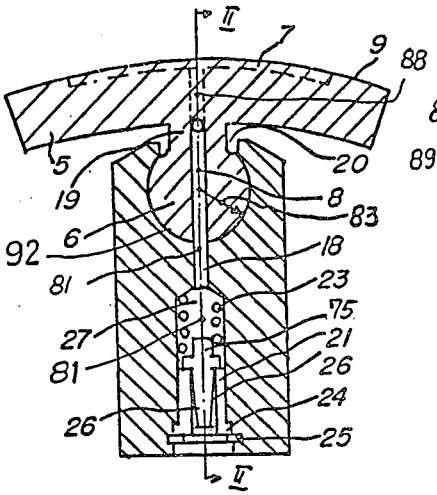
FIG. 1 is a longitudinal sectional view through an embodiment of a piston-piston shoe assembly of the invention.
Figure 2:
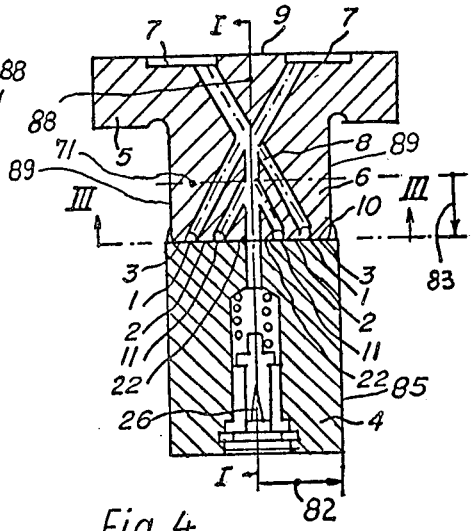
FIG. 2 is a cross-sectional view through FIG. 1 along line II—II.
Figure 3:
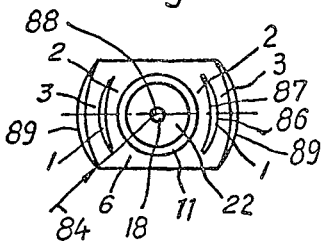
FIG. 3 is a view onto the bottom of the pivot bar portion of FIG. 2 along the line III—III.

In FIGS. 1 to 3 numbers 4 show the piston; 5 show the piston shoe; 6 show the pivot bar portion; 7 show balancing recesses in the outer face of the piston shoe; 8 show communication passages in the piston shoe; 18 show a communication passage in the piston and 9 show the outer face of the piston shoe of the former art. Insofar the respective means of the inventional embodiment are equal to those of the known former art. Pivot-bar portion 6 is inserted into and borne in the known slotted bore of piston 4. Between the outer portion 5 of the piston shoe and the innermost pivot-bar portion 6 of the piston shoe is the known narrow medial portion or neck 19 of the piston shoe. It is able to swing or pivot in the slot 20, which extends from the slotted bore to one end of the piston 4. Referential numbers 46 and 44 are similar known parts of the former art in FIG. 7. The pistons 4 have cylindrical outer faces 85 which are formed by a second radius 82 around the first axes 81. Each piston 4 has a first axis 81, which is it's longitudinal axis 81.

Figure 8:
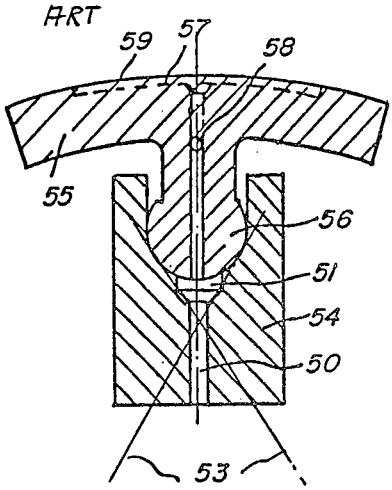
Fig. 8 PRIOR ART
FIG. 8 shows a longitudinal sectional view through another embodiment of the former art for explanatory purposes.

For the best understanding of the invention I will now discuss FIG. 8. FIG. 8 shows a conventional piston with a part-spherical bearing bed wherein a piston shoe foot 56 which forms a similar complementary part-spherical face-portion is pivotably borne. The piston is shown by 54 with the common passage 50. Piston shoe 55 has passage 58 and outer balancing pocket 57 in outer face 59. Since friction was appearing between the piston's bed and pivot foot 56 it was attempted to provide a fluidpressure balancing pocket 51 between piston 54 and pivot portion 56. This reduced the load between said both parts, but at same time it pressed the portion 56 by a mean tangent 55 almost like a cone into the spherically former taper-cone. That led to such high friction, that the piston shoe 55 almost sticked in said piston 54 by said taper-cone action of medial tangents 53. Thus, instead of reducing friction between the piston and piston shoe the friction became actually increased. The arrangement of FIG. 8 of the known art is therefore an error.

Figure 6:
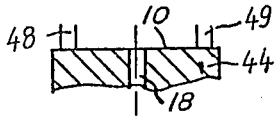
Fig. 6 PRIOR ART
FIG. 6 demonstrates the sealing end portions of the former art.
Figure 7:
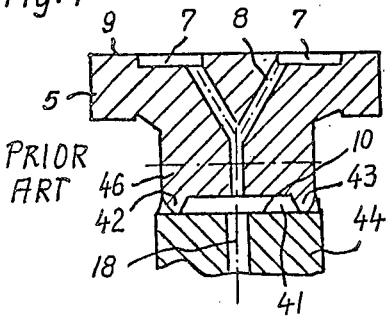
FIG. 7 shows a portion of the piston-piston-shoe assembly of the former art.

With this new knowledge I can now discuss FIG. 7 of applicant's patents of the known art. Piston 44 carries in its slotted bore the pivot-bar portion 46. The bottom of the slotted bore is cited by numeral 10 in FIGS. 2,3,5,6, and 7. The other numbers as far as they are similar to FIGS. 1 and 2 are similar means in FIG. 7. The pivot bar portion has the extended fluid pressure balancing pocket 41. On the ends thereof the sealing end portions 43 are provided and borne in the slotted-bore bed of piston 44. Pressurized fluid enters from the cylinder through passage 18 into the respective balancing pocket, for example 41, of FIG. 7 and into the passages 8 in the piston shoe 5, as known from the former art.

Figure 4:
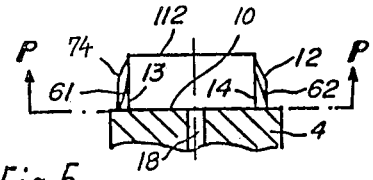
FIG. 4 demonstrates the pressure in fluid on the bottom of the pivot-bar portion.

This invention now discovers, that, as shown in FIG. 4, the pressure "p" rises between the bed face 10 and the faces of the end seal portions 42 and 43 along the lines 61 and 62 of FIG. 4 to a maximum pressure 112. All this schematized pressure acts to reduce the load between piston and piston shoe. This invention now further discovered, that the courved pressure gradients 61 and 62 allowed only very little lubrication fluid to enter between the faces 10 and faces of seal portions 42 and 43. Thus, at high pressures and speeds, the sealing areas got mixed-or dry friction occurred between parts 42,43 and 10. The friction became as dryer as more the distance from the axis of the piston 44 was. The result of this almost dry friction was an increase in friction, a wear off and a reduction of efficiency and life time. The friction losses and life time losses became at high pressures in fluid and at high working speeds so considerable, that the high pressure-high speed devices could not any more be considered as most effective devices.

The sizes of the seal portions in the direction parallel to the axis 71 of the pivot-bar-portion is schematically demonstrated by referential numbers 48 and 49 in FIG. 6.

The in detail described drawbacks of the known piston-piston-shoe assembly of applicant's patents are overcome by this invention. This is materialized by the provision of a plurality of balancing fluid pressure pocket recesses 1 and the provision of bearing portions 2 between those recesses 1 on the pivot-bar portion 6. This is demonstrated in FIG. 2. In FIG. 3, where different locations of recesses 1 and of portions 2 are visible, the different recesses are shown by 1, 11 and by passage 18. The differently located bearing portions 2 are shown therein by 2 and 22.

One or more, but at least one, communication passage, for example bores, 8, are provided in order to communicate each fluid pressure pocket recess 1 with communication passage 18 in piston 4. The simplest embodiment is, to provide only one annular fluid pressure pocket recess 11 as shown in FIG. 3, whereby at least one bearing portion 2 is established between central passage 18 (FIGS. 3 and 1) and recess 11. Thus, from the innermost recess 11 and medial recess 18 or central passage 18 or bore 18 fluid is forced under pressure from both ends into the clearance between the respective portions of face of the wall of the slotted-bore the respective bearing portions 2 of pivot-bar portion 6. Thereby the respective bearing portion 2 almost floats on a pressurized fluid film almost equal to the maximum pressure in the fluid. Recesses are defined by one or more digits 1. Bearing portions are defined by one or more digits 2.

For bigger sized piston shoe and piston assemblies it is suitable, to provide a plurality of fluid pressure pocket recesses 1,11,111 etc. That is shown in FIG. 2 and also in FIG. 3. FIG. 3 is a view from botton onto the pivot bar portion 6 of FIG. 2. It also shows the axial ends 89 of the pivot bar portion 6, which are in this embodiment formed by a third radius 84 around a fourth axis 88. Thus, one sees one central bore or recess 18,8 and four balancing recess portions 1,11 in FIG. 2 and one sees four bearing portions 2,22, between them in FIG. 2. The outer sealing portions 3 are also seen in FIGS. 2 and 3. According to the invention, there is now a difference in function between the bearing portions 2 and the sealing portions 3. The bearing portions 2 are force-lubricated from two sides or ends and are therefore loaded with high pressure fluid. That enables them to carry out the function of bearing under low friction. The sealing end portions 3 have the different function of sealing and of bearing. Since however, the main load is borne by the bearing protions 2, the fluid films below them act also to reduce the bearing load of the pivot-bar portion 6 a little, relatively to the bottom of bed 10, so that a little less load appears also between the end portions 3 and the bed face 10. This little reduction of relative load on the sealing end portions 3 brings the new effect, that the pressure gradient changes from lines 61,62 in FIG. 4 to pressure gradients 74 and 12 of a more outwardly directed form. That means, that more pressure fluid enters the clearance below the sealing end portions 3, thereby lubricates them better, carries more load and reduces friction better, than in the assembly of FIG. 7 of the former art of inventor's earlier patents. Regarding FIG. 3 it may be noted, that two of the four pockets 1 in FIG. 4 may also be considered as a single pocket, namely as the circular recess 1 of FIG. 3.

Figure 5:
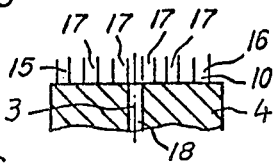
FIG. 5 demonstrates the sealing end portions and the force-lubricated medial bearing portions of FIGS. 1,2 and 3.

FIG. 5 demonstrates the sizes of end portions 15,16 and of bearing portions 17 schematically along bottom face 10 of piston 4, according to FIG. 2. Between sealing end areas 15 and 16 and bearing face areas 17 are the recesses 1,3 of the invention. It is suitable, to make central recess 3 much smaller, than the fluid pressure pockets 41 of the former art in order to obtain as much bearing area 17 as possible.

The lines 74,112,12 in FIG. 4 demonstrate the high fluid pressure bearing pressure and thereby bearing capacity of the embodiment of FIGS. 1 to 3 of the invention. This is higher, than the capacity of lines 61,112,62 of FIG. 4 of the assembly of FIG. 7 of the cited former art.

Still more effective is the increase in lifetime and the reduction of load on portions of the walls of pivot bar portion 6 and of piston's face 10.

Areas 48 plus 49 of former art may have been about 10 percent of the cross-sectional area of the piston in highest class devices of FIG. 7. But bearing areas 17 of FIG. 5 depending on FIG. 2 may be 40 percent of the cross-sectional area of the piston 4,44. End face areas 15,16 may be the same as 48,49. Thus, the load excerted onto the contacting faces in the former art was:

$$\frac{(D^2\ \text{pi}/4)p \text{ minus } 61,112,62/48 + 49 = \text{about}}{\text{with areas } 48 + 49 = \text{about } 0,1(D^2\ \text{pi}/4)} \quad (1)$$

but the load excerted onto the contacting faces in the invention is only:

$$\frac{(D^2\ \text{pi}/4)p \text{ minus } 11,112,12/15 + 16 + \text{sum of } 17}{\text{with areas } 15 + 16 + \text{sum of } 17 = \text{about } 0,5(D^2\ \text{pi}/4)} \quad (2)$$

Or, in other words: The load excerted onto the contacting faces of the invention can be about 5 times less, than in the former art of applicant's former patents. That increases the lifetime multifold and increases the efficiency of the devices of the invention greatly.

It should also be noted, that the centre line of the bottom of the cross bore, namely number 10, is exactly normal to the direction of load. Thus, there is no tapered sticking under load as in FIG. 8 of the former art. This elimination of sticking by pressing together of faces in a cone-like structure gives also a very high efficiency and life time to the device of the invention.

Thus, in summary, the invention provides the most extended contact faces, the most extended fluid pressure balancing area and action, the most efficient sealing end face portions, the best direction of bearing face power, most less friction and most efficiency and life time.

While the specific and preferred embodiment is described as a piston and a pivote bar portion of a piston shoe, it is quite sure, that the invention is also applicable to any body having a bearing-bed, face or bore preferably normal to the axis of said body in said body and a part-cylindrical or cylindrical pivot-body borne in said bed, face or bore. Provided, that communication passages are provided in said body and fluid under pressure is entered into the recesses of the invention in said body or bodies.

In FIGS. 1 and 2 are restriction means shown for the restriction of flow through passage 18. This is suitable to press the piston and shoe assembly out of the cylinder under force of pressure in fluid. Restriction housing 21 may be provided with a bore and/or seat for the reception of a valve member 75. Valve member 75 may be pressed into closing position by spring means 23 in piston 4. Valve member 24 may be provided with gradially increasing recesses 26 for flow of fluid through them in the more or less opened position. The opening of them occurs, when fluid under pressure acts from the bottom against the said valve member 75. Valve housing 21 may have a shoulder 24 and fastened therewith and with a retaining means 25 in a respective seat in piston 4. This assembly is especially suitable for high speed pumps and also for motors.

The invention has so far been described in general language. It has been found however, that such terms, which were occasionally used, as "cross-bore" or "slotted bore" are sometimes misunderstood or otherwise interpreted than as desired.

The invention will therefore in the following be defined in strict mathematical or geometrical terms. To understand them also by those who are not accustomed to such pure geometrical language it may be noted, that; in the following:

the Piston 4,44 is called: a first body;

the piston shoe 5 is called: a second body;

the pivot-portion 6 is called: a member;

the piston's longitudinal axis 81 is called: a first axis;

the axis 71 through the slotted bore of the piston is called: a second axis;

the axis 71 through the pivot-bar 6 which is equally located with the second axis through the piston is called: a third axis;

the axis 88 through the medial bore 8 of the piston shoe is called: a fourth axis;

the radii 83 of the slotted bore and of the pivot portion or member are called first radii;

the radius 82 around the first axis 81 of the piston is called: a second radius;

the face 3 of the slotted bore 10 piston is called: a bedface;

the slotted bore in the piston is called: an outcut; including a bearing bed;

the face of the outcut is called: a bed 40 or a bed face 31;

the outer face 32 of the pivot portion 6 is called: a bearing face; and, the pivot portion is consequentely also called: a member of the second body;

the axial ends of the member 6 are called front end 33 and rear end 34 or ends 89, when they are part-cylindrically formed with the third radius 84 around the fourth axis 88.

The walls of crescent shaped recess may be tapered, convex, cylindrical or concave surfaces 86,87 of (multiple) radii around the fourth axis 88.

The recesses of the invention are defined by one or more digit(s): 1.

The bearing portions of the invention are defined by one or more digit(s): 2.

Of importance for an understanding of the specification is, that in order to avoid confusion and in order to avoid alternatives in the specification or claims, the term: "at least" shall define, when used in the specification or in the claims: "a minimum of" or "a smallest number of" or a smallest amount of". For example, a minimum of one or more, a minimum of two or more, whereby the term "at least one" includes a single one or a plurality and whereby the term: "at least two" includes a plurality of just two, but also a plurality of more than two. The term "at least" is known from many patents and it is defined in The Merriam-Webster Dictionary, edition of 1974, page 402. ((at least=adv. of leastwise.)).

During the examination of the parental and of the grand-parental application it has been found, that a number of former art patents are rather new. They have worked on technological problems of on each other sliding or pivoting faces or portions of bodies. For example, the German patent application publication of Linde-Ahrens, number 2,460,512 deals with rolling bars of cylindrical outer faces in a part-cylindrically formed bed. This application was published on June 24th, 1976, which is just a short time ago. In this document recesses were provided in the bed and they were filled with fluid under pressure. The supply of fluid into the recesses or pockets created a hydrodynamic pressure field around the pockets, whereon a considerable portion of the load of the roller was borne. Since the mentioned publication is of a date of about just a year ago, it was assumed, that the matter dealt with most up to date technology, and, in fact, it does so. From the patent document however the impression arose, that the provision of such fluid pressure pockets or recesses as in the Linde-Ahrens patent publication would work in any case and in very application with the same effect, as it works in the mentioned patent publication. My discovery however is, that the recesses of the mentioned Linde-Ahrens publication can not work in the arrangement of the two bodies of my invention, which only pivot relatively to each other; but which do not roll relatively to each other. I have therefore in this application supplied the explanatory FIGS. 9 to 25. In the description of these figures I will more in detail explain the differences of function and of effect of the mentioned former art and of the arrangement of my present invention.

The arrangement of the former art, which I illustrate in FIG. 8, is for example in principle known from U.S. Pat. No. 3,395,948 of Andrews, from the Swiss Pat. No. 574,041 of the Bosch Corporation and also from other, newer U.S. Patents of the Bosch corporation. Since all these patents are also very young, for example, they were issued in the end sixties or in the seventies, it was again assumed, that these patents would show the highest advanced technology in the field. Therefrom it was assumed, that these patents would work perfectly under all conditions. As I have described in this application at the description of FIG. 8 of the former art, the true fact however is, that these arrangements have disadvantages and even create a high friction and tendency to weld at specific locations.

Because of this interference of understanding of the newer patents of the former art with my present invention, I have in this present continuation in part application added explanatory figures to explain more in detail the problems and technologies as well as the different functions and effects, which are involved in the former art and in my present invention. But I have not added any new figures or solutions of my invention, which have not already been present in my grand-parental and in my parental patent application.

Figure 9:
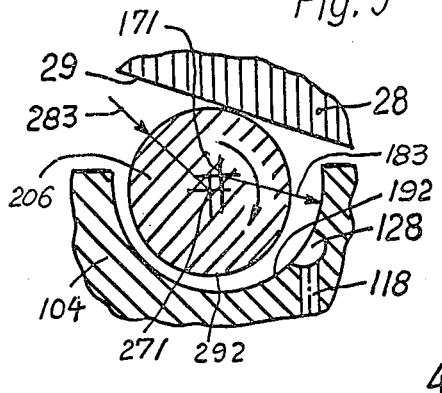
PRIOR ART Fig. 9
FIG. 9 is a cross-sectional view through an embodiment of the former art.
Figure 11:
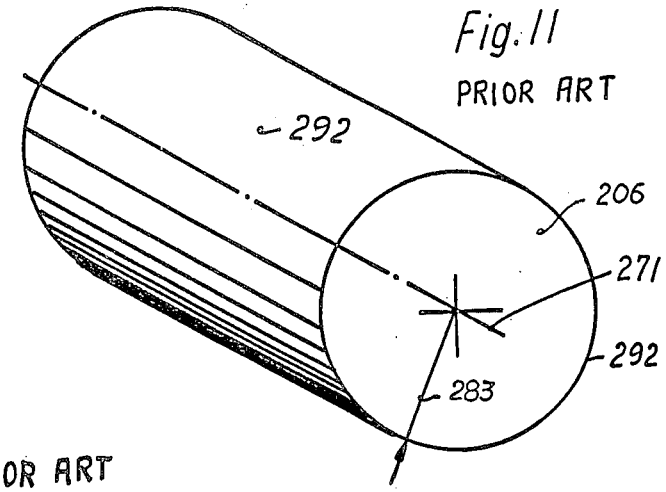
Fig. 11 PRIOR ART
FIG. 11 is a spherical view onto a second body of the former art.
Figure 10:
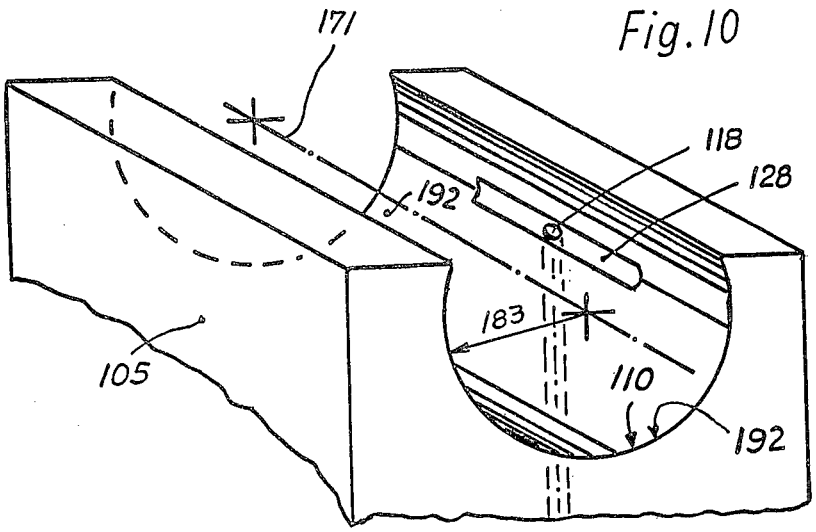
FIG. 10 is a spherical view onto a first body of the former art.

Referring first to the basic principle of the rolling bar, borne in a part-cylindrical bed, of for example, the mentioned Linde-Ahrens patent application publication, this is demonstrated in FIG. 9 and in FIGS. 10 to 11 of the present patent application.

FIG. 9 is a cross-sectional view through a roller, the body with the bearing bed and a guide arrangement.

FIG. 10 shows the first body 104 of FIG. 9 in an enlarged scale and in a perspective view.

FIG. 11 shows the second body or roller 106 of FIG. 9 in an enlarged spherical view.

The principle of the former art of these figures may be best understood by considering FIGS. 9 to 11 together. The second body forms a bar or roller 206 with a cylindrical outer face of a first radius 283 around its longitudinal or third axis 271. The first body 104 forms a bearing bed 110 of part-cylindrical configuration of a fifth radius 183 around the second axis 171. Second body or roller 206 rolls along the guide face 29 of a guide body 28. Thereby the roller 206 obtains a movement of rolling in the direction of the arrow in FIG. 9.

The first body 104 is provided with a passage 118 which ports into the recess or fluid pressure pocket 128. Pocket 128 is open towards the bed 110. The second body 206 lies normally rest in bed 110. Bed 110 corresponds in principle and can be in actual size equal to the bed 10 of invention. When body 104 moves relatively to the guide body 28, the rolling movement of the roller 206 is obtained, because it has a line contact with guide face 29. This line contact causes friction, when a load is acting between body 206 and guide face 29. When the rolling movement of the second body 206 occurs in the bed 110 of the first body 104, the outer face 292 of roller 206 tracts or draws fluid out of pocket or recess 128 into the clearance between the bearing bed face 192 of bed 110 and the outer face 292 of the roller 206. Provided, that the roller 206 rolls with a fast rotary angular velocity, the fluid in the mentioned clearance between the faces 192 and 292 will carry the load, which is present between the first body 104 and the second body 206. So far, the design of the prior art and its principle is correct. Correct also is, that this principle of the former art can be managed to work properly by known calculations. The principle discussed here, is the principle of the hydrodynamic bearing.

Of importance in this respect is however, that there must be a slight difference between the radius 183 and radius 283. For example, the radius 283 may be one hundredth or one thousandth or a respective other value, of the radius 283. And, when then the roller rolls with high rotary velocity, the axes 171 and 271 will be parallel to each other, but they will not absolutely and perfectly coinciding. This is seen in FIG. 9. The distance between the axes 171 and 271 will appear automatically in dependance on the load and on the relative velocity between the faces 192 and 292, as well as on the difference of the radii 183 and 283. Such hydrodynamic bearing action can appear however only, if the relative velocity between the faces 192 and 292 is very high. Or, when the rotary angular velocity of the roller 206 is respectively high. Otherwise, if the relative speed between the faces 192 and 292 would be too small, there would not be enough hydrodynamic bearing capacity and the faces 192 and 292 would meet in a line contact and would weld there. The arrangement would then be disturbed. The required relative velocities, clearances, fluid quantity, fluid pressures, bearing capacity, viscosity of fluid and the like can be calculated from the hydrodynamic bearing technology. The pressure in pocket 128 would have to be added to the hydrodynamic bearing technology.

Figure 13:
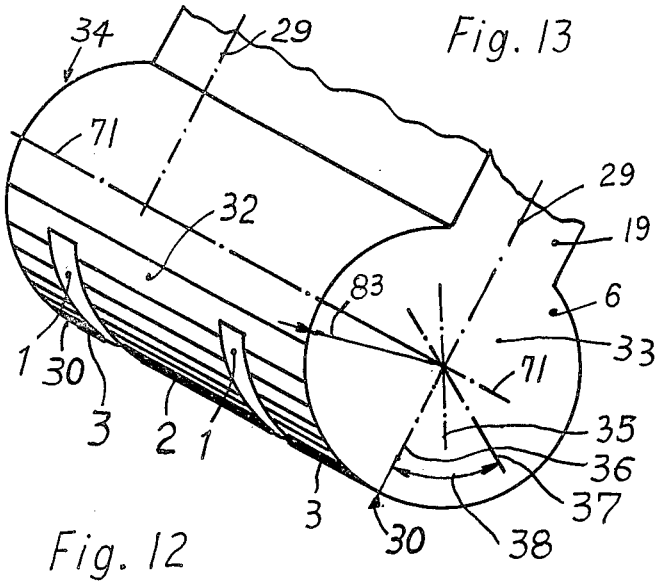
FIG. 13 is a spherical view onto a second body of the invention.
Figure 12:
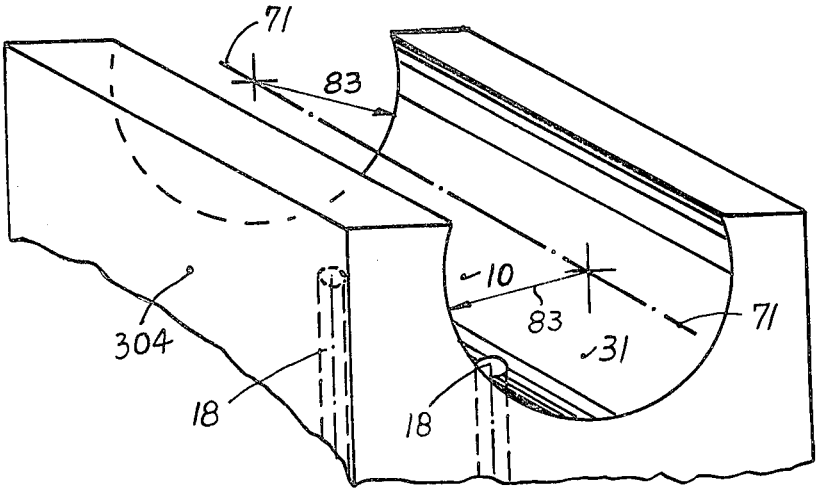
FIG. 12 is a spherical view onto a first body of the invention.
Figure 20:
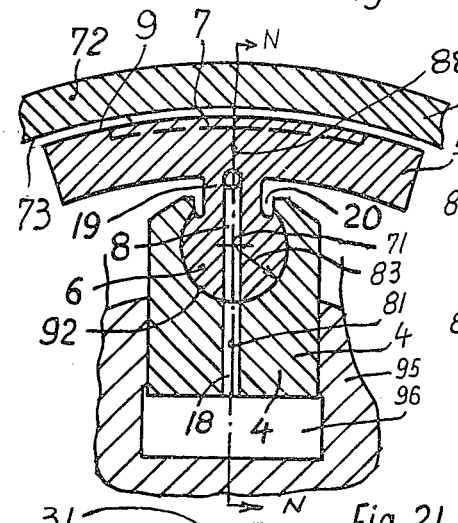
FIG. 20 is a sectional view through FIG. 19 along the arrow: "M—M".
Figure 19:
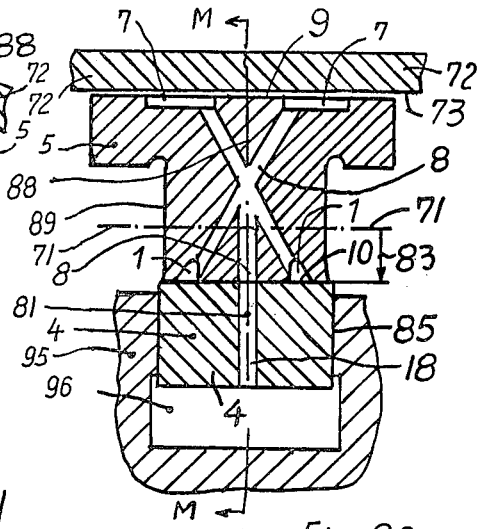
FIG. 19 is a sectional view through a portion of an embodiment of the invention, whereby it is also a sectional view through FIG. 20 along the arrow: N—N.
Figure 21:
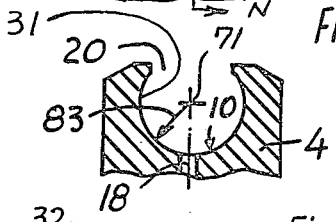
FIG. 21 demonstrates a portion of FIGS. 19,20 in a separated sectional view along the arrow "M—M" of FIG. 19.
Figure 22:
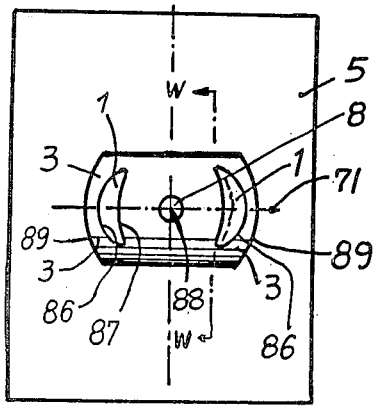
FIG. 22 is a view from bottom onto member 6 and body 5 of FIG. 19.
Figure 23:
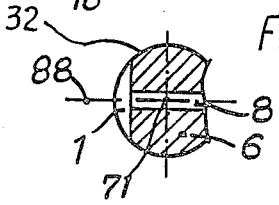
FIG. 23 is a sectional view through a portion of FIG. 22 along the arrow: "W—W".

The difference of the above hydrodynamic principle of the former art and of the principle of the present invention, will now be further explained by the description of FIGS. 12 and 13.

FIGS. 12 and 13 demonstrate an embodiment of the invention in a spherical view. FIG. 12 demonstrates a portion of the first body and FIG. 13 demonstrates a portion of the second body of the invention.

The first body 304 has a second axis 71 which is the centre line of a pivot bed or bearing bed 10. The bearing bed 10 is an outcut in the first body 304. The bearing bed 10 is formed by a first radius 83 around the mentioned second axis 71. Thereby the outcut is at least a part of a cylinder, or a part-cylindrical outcut. The bed face 31 of bearing bed 10 is a portion of the bearing bed 10 and it is also of part-cylindrical configuration of the first radius 83 around the second axis 71. A passage 18 or a plurality of passages 18 extends (extend) through the first body 304 towards the bearing bed 10 and port thereinto. These passages 18 are communicated to a space with fluid under pressure and they are serving to supply pressure fluid to the bearing bed 10. The first body of FIG. 12 is principielly known from my earlier patents. The arrangement of two bodies of the invention thereby includes a first body 4 or 304 provided with a bearing bed 10 which coincides with a bed face 31 and which is formed by a first radius 83 around a second axis 71, whereby the bearing bed 10 with face 31 forms a bearing bed of part-cylindrical configuration.

The second body of FIG. 13 has a third axis 71, wherearound a partially cylindrical member 6 is formed by another first radius 83. The first radii 83 of the first body and of the second body are substantially equal. The first radius of the second body may be very slightly shorter than the first radius 83 of the first body. Thereby the part-cylindrical member 6 of the second body can be laid into the bearing bed 10 of the first body. Member 6 is then able to pivot in bed 10 of the first body. The second body has thereby a medial face of pivotion, 29, which extends through the mentioned third axis of the member 6 and which may define symmetrical halves of the second body. The medial face of pivotion, 29, can then pivot in the bed 10 of the first body 4,304 by an angle of pivotion 38 between the borders of pivotion 36 and 37. The neutral position at which the second member is not pivoted is shown by the neutral medial face location 35. When the member 6 of the second body is laid into the bed 10 of the first body 4,304, the second axis 71 of the first body and the third axis 71 of the second body 6 are practically coinciding. Therefore a single referential number is used for these two axes 71. The outer face of the part-cylindrical member 6 may be formed by a part cylindrical bearing face 32 which is then also formed by the first radius 83 of the second body around the third axis 71 of the second body. When the second body 6 is laid into the bed 10 of the first body, the faces 31 and 32 are laying on each other with no or with extremely narrow clearance and form together the pivot faces or faces of pivotion 92. These are the faces 31 and 32 of body 4 and portion 6. Since the first radii 83 of the second and of the first body are practically of equal length, they are also given a single referential number, namely 83. At assembly, the radii 83 of the first and second body are coinciding.

The member 6 of the second body has a front end 33 and a rear end 34. So far, the second body is also known from my earlier patents.

According to the present invention, at least two recesses 1 are provided substantially parallel to the ends 33 and 34 of the portion or member 6 of the second body. The second body may also consist of just a part-cylindrical member 6. The recesses 1 of the invention are also called fluid pressure pockets. The expression pockets is known from my earlier patents or from some thereof. The expression: "at least two recesses" shall define, that there is provided a minimum of two recesses. In other words, that there is provided a plurality of recesses. This may be two or more recesses 1, when the expression: "at least two recesses" is used in this specification or in the claims. The at least two recesses 1 are distanced from the ends 33 and 34 of the second body 6 to form between the respective recess 1 and the respective end 33 or 34 a sealing land 3, which are also called: "the outer sealing portion 3". Between the at least two recesses 1, whereof only two recesses 1 are shown in FIG. 12, the bearing land(s) 2 is (are) formed and also called: "the bearing portion(s) 2". In FIG. 12 there is only one bearing portion 2, because there are only two recesses 1 shown. A bearing portion must always be located between two recesses 1 or 1 and 11 or 1 and 111 or 11 and 111, because the bearing portion 2 of the invention shall at all times be subjected to fluid pressure from recesses on both axial ends of the respective bearing portion 2. The bearing portions 2 are as well as the sealing lands 3 are portions of the outer face 32 of the pivot portion 6 or member 6 or second body 6.

After assembly of the second body 6 into the bed 10 of the first body 4,304, the faces 31 and 32, the radii 83 and the axes 71 are practically coinciding and the passage(s) 18 through the first body 4,304 communicate with the recess(es) 1 to supply fluid under pressure into the recess(es) 1.

The assembly of two bodies of the invention thereby includes a second body which forms a part-cylindrical pivot member 6 by a first radius 83 around the third axis 71 which coincides with the second axis of the first body, wherein the pivot member 6 of the second body has a front end and a rear end, 33 and 34, as so far known from my earlier patents, however with an improvement provided by the present invention and which consists in the provision of at least two fluid pressure balancing recesses 1 which are substantially parallel to the said ends of the member 6 and which are distanced from the said ends of the member 6 in order to form outer sealing lands or sealing portions 3 between the respective recess 1 and the respective end, and, also in order to provide at least one bearing portion 2 between at least two recesses 1,11,111, whereby the said bearing portion(s) 2 is (are) subjected to fluid under pressure from the respective recesses 1,11,111 on both axial ends of the said bearing land(s) or bearing portion(s) 2.

Figure 14:
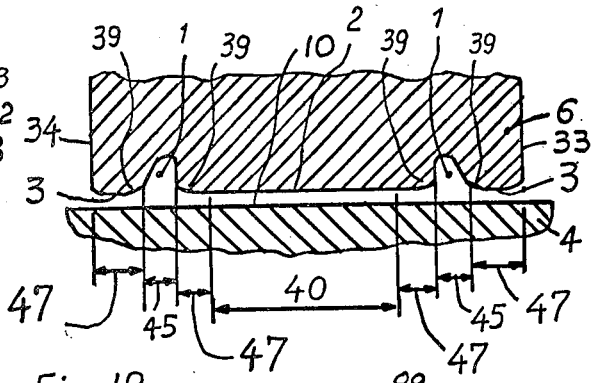
FIG. 14 is a longitudinal sectional view through portions of the invention.

In FIG. 14 a portion of the first body and of the second body is demonstrated with an enlarged clearance between them and with enlarged machining or producing appearances. Body 6 is again pivotably borne on bed 10 of the first body 4. The recesses 1 of the invention, as shown in FIG. 13, are visibly provided in member 6. In the arrangement of the invention, the faces 31 and 32 of the first an second bodies must be close together, because otherwise the load would concentrate on the line 30–30 of FIG. 13. Such concentration of load would bring the tendency of welding. The closeness of the clearance between the faces 31 and 32 of radius 83 around axes 71 is therefore an important "know-how" of the present invention, because it prevents the concentration of the load in the line 30—30 and includes the neighbouring face portions of the faces 31 and 32 into the carrying of the major portion of the load between the first and second body.

In order to produce the close clearance, a grinding of the faces 31 and 32 is commonly not satisfactory and a lapping is required. Thereby the ends of the recesses are slightly inclining to inclined face portions 39, which are visible in FIG. 14. This inclination can not be prevented at lapping, and, in fact, this inclination is even desired by the "know-how" of the present invention. Attention should be given to the enlarged scale in FIG. 14. Actually the inclination of faces portions 39 remains commonly below 0,01 mm at the maximum of distance from the ideal cylindrical shape of radius 83 around axis 71 of the second body 6.

It should be noted, that in the present arrangement of two bodies of the invention, there is no rolling body, but only a pivoting second body. The relative speed between the relatively to each other moving faces 31 and 32 is therefore at least ten times smaller than in the arrangement of the former art of FIGS. 10 and 11. With such small relative velocity between adjacent faces and with no balancing recess in the direction of movement of the faces relatively to each other, no fluid is drawn into the narrow clearance between faces 31 and 32 of the invention. The hydrodynamic bearing action of FIGS. 10 and 12 can not develop in the arrangement of the invention, because the required high relative velocity between the adjacent faces 31 and 32 can not be obtained by the pivotion of the second body 6 in the bed 10 of the first body 4.

Consequently, the novel arrangement of the invention has to be carried out. That is the provision of the at least two fluid pressure recesses or pockets 1 substantially parallel to the ends 33 and 34 of the member 6 to form the outer sealing lands 3 and at least one bearing portion 2 between at least two recesses 1 in order to force-lubricate the bearing portion 2 from both axial ends thereof, out of the recesses 1.

To the "know-how" of the invention belongs also the discovery, that fluid enters into such a small clearance as it appears between the faces 31 and 32 of the invention only in a very short length. Commonly only a very few millimeters. FIG. 14 therefore demonstrates perfectly lubricated areas 45, and part-perfectly lubricated areas 47, whereinto fluid enters from the respective recess(es) 1. The medial bearing land or bearing portion 2 is thereby at least partially perfectly lubricated. At very high load however, the lubrication of the bearing land 2 may be so imperfect, that this FIG. 14 might fail in operation and the figure would have to be replaced by the arrangement of the member 6 of the second body of FIGS. 1, 2, 3 or of FIGS. 15 to 17. It should however be appreciated, that the member 6 of FIG. 14 or of other figures may not only pivot but also partially move axially. Therefore, the face 32 may not only pivot but also move or only move axially along the face 31. In case of such arrangement, the FIG. 14 provides a satisfactory solution of the problem and thereby an important embodiment of the invention.

Figure 15:
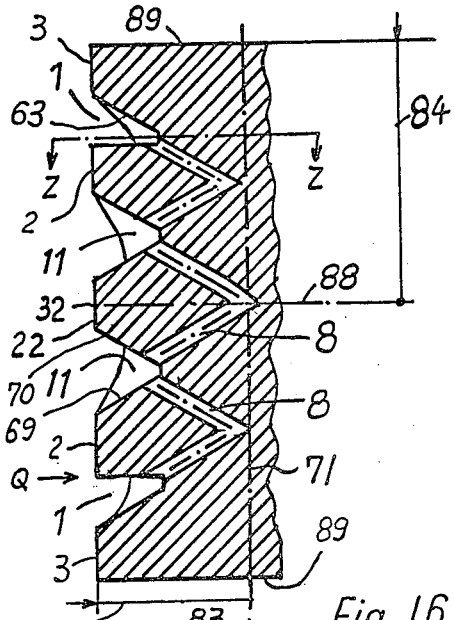
FIG. 15 is a longitudinal sectional view through a second body portion of the invention, while it is also a sectional view along "X—X" of FIG. 18.
Figure 16:
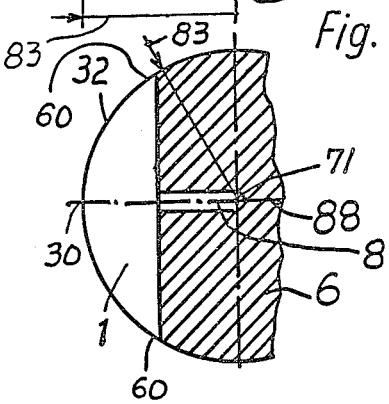
FIG. 16 is a cross-sectional view through FIG. 15 along the arrow: Z—Z.
Figure 17:
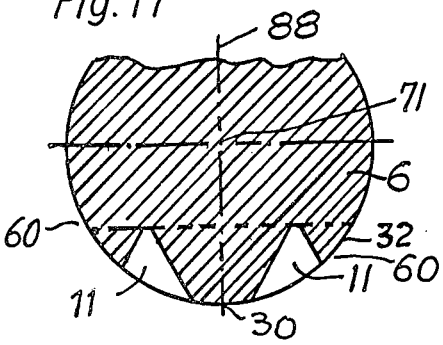
FIG. 17 is a sectional view through FIG. 18 along the arrowed line Y—Y.

In FIGS. 15 to 18 a portion of a pivot member or part-cylindrical member 6 is demonstrated in a large scale to show the details visibly thereof. FIG. 15 is a sectional view through FIG. 18 along the arrow X—X of FIG. 18. FIG. 16 is a sectional view through FIG. 15 along the arrow Z—Z in FIG. 15 and FIG. 17 is a sectional view through FIG. 18 along the arrow Y—Y of FIG. 18.

The ends of the pivot bar member 6 are formed by the ends 33,34 as at least partially cylindrical faces 89 with a third radius 84 around a fourth axis 88. When the pivot member 6 is in the neutral position, which means, without pivotion, respectively to the first axis of the first body 4, the fourth axis 88 is coinciding with the first axis 81 of the first body 4,304 etc. The fourth axis 88 is shown in all four figures and it will be further explained at the discussion of FIG. 25. The fourth axis 88 is also the centre line of the plane of pivotion 29, when the member 6 is symmetrically in both axial directions.

According to this embodiment of the invention, the recesses or fluid pressure pockets 1—namely two of them—are provided substantially parallel to the ends 33,34 of the member 6, but inwardly distanced therefrom to form the sealing portions or sealing lands 3 of the invention. Visible in FIG. 15 is, that the inner walls of the recesses are cut normal to the third axis 71 with a radius 62 around the fourth axis 88. The outer faces of the recesses 1 are cut under approximately 30 (60, when seen complementary thereto) degrees to form inclined faces of substantially concave, convex, or tapered formed curvature of (multiple) radii 61 around the fourth axis 88. When the walls 63 of recesses 1 are formed straight under a permanent angle, as shown in FIG. 15, they form a tapered curvature of (multiple) radii 61 around the fourth axis 88.

In the embodiment of FIGS. 15 to 18 of the invention, there is a further recess 11 provided. This recess forms a common recess 11 of substantially circular configuration. All recesses of the invention are exclusively defined by digits 1. Either by a single digit 1 or by plural digits 1. For example, by 11, 111 or the like, if more than two, three or respectively four recesses are provided. All recesses with exlusively digits 1 are equal in effect and application, but they are differently located. Similarily all bearing portions between recesses 1,11,111 etc are defined in this specification exlusively by digits 2. For example, by digit 2,22,222 or the like. The digits 22 or 222 are appearing either in this application or in practical application of the invention, when more than two, three or four bearing portions 2 are provided. Bearing portions 2,22 or 222 are equal in application effect and function, but they differ in the location.

The more than two recesses 1,11,111 and more than one bearing portion 2,22,222 are provided in such embodiments of the invention, where, as in FIG. 14, the bearing portion 2 would become too long in the axial direction and, when thereby the lubrication of the respective bearing face portion would be unsecured. According to the matter which is discussed in the description of FIG. 14 etc, the face portions of face 32 must be axially short in order to secure a proper supply of fluid between the faces 31 and 32 of the first and second bodies of the invention. The provision of more than two recesses 1, namely of additional recesses 11, 111 and/or bearing portions 2,22,222 secures, that the axial directions of the bearing portions 2,22,222 are short and thereby permit the entrance of fluid between the faces 31 and 32 in order to secure the lubrication between these faces 31 and 32.

Figure 18:
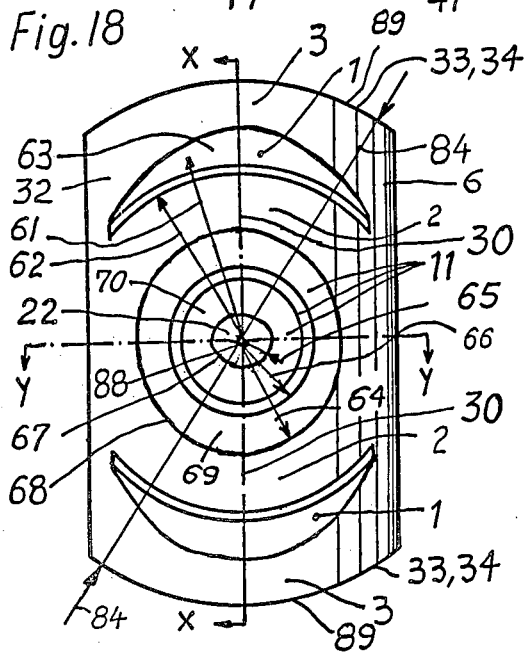
FIG. 18 is a view onto FIG. 15 from the arrow "Q".

Accordingly the additional recess 11 is provided in FIGS. 15 to 18. It is located inwards of the outer recesses 1 and thereby it is an inner recess or pocket 11. The bottom of it is an annular bottom with an outer face of radius 66 around the fourth axis 88. The outer wall forms in the figures a concave or a tapered wall 69 of (multiple) radii around the fourth axis 88, while the inner wall forms a concave, convex or cylindrical wall of a radius or of (multiple) radii around the fourth axis 88. In the figure the walls 69 and 70 of the recess 11 are tapered wall portions. It should be noted, that, even when the recess 11 is lathed around the fourth axis 88, the outer ends of the walls 69 and 70 of the recess 11 are not fully annular any more, because of the cutting into the part-cylindrical configuration of member 6. The FIG. 18 shows, that the inner ends of radii 65 around axis 88 of the recess walls are closer together in the X—X arrow direction, while the outer ends of the outer walls 69 are closer together in the direction of the arrow Y—Y.

As has been found in accordance with this present invention, the provision of recesses as in FIGS. 1 to 3 or as in FIGS. 15 to 18 with the respective sealing lands 3 and bearing portions 2,22 is quite ideal in practical application. Because, the highest load is always in the line 30—30 of FIG. 13. The load on the therefrom 90 degrees to each side turned portions of faces 32 is smaller, because there the face portions of face 32 do not meet the face portion of face 31 under a steep angle of 90 degrees, but under a small angle of relative inclination. Consequently, since the load is less at locations 60 (see FIGS. 16 and 17) than at location(s) 30, the axial length of the bearing face portions can be longer at locations 60 than at locations 30 in the figures. The embodiment of FIGS. 15 to 18 therefore brings an ideal baoance of the sizes and locations of recesses and an ideal securance of the entering of fluid into the respective portions between faces 31 and 32 of the first and second body.

FIGS. 15 to 18 thereby demonstrate in combination with FIGS. 1 to 3, that the portions, namely bed 10 and member 6 as well as faces 31 and 32 include straight lines 30 and thereto adjacent face portions around the line 30 which are extending substantially normal to the direction of the load between the first and second body, and, that at least two (which can be two or more than two) of the recesses of the arrangement, namely recesses 1, are substantially crescent shaped and include substantially concave and convex or tapered surfaces substantially of radii 61,62 around the fourth axis 88. The rest of the recesses may also be substantially cresent shaped, f.e.: 22, if they are axially farther away from the fourth axis 88 or they may be substantially, but not exactly, annular recesses, for example 22,222 when they are closer to the fourth axis 88 located.

In FIGS. 19 to 23 the first body 4 is a piston of a radial piston machine. It is located in and reciprocable in cylinders 96 of a rotor 95. The second body is a piston shoe of the same machine. It has an outer guide face 9 which is a slide face and runs along the inner face 73 or thereby along the piston stroke guide face 73 of a piston stroke guide or actuator-element 72. The second body includes the pivot portion or pivotable member 6 to be borne and to pivot in bed 10 of the first member or piston 4. The guide face 73 may be a cylindrical face around an axis which is parallel to the axis of the rotor 95 but eccentricall distanced therefrom. During revolution of either the rotor 95 or of the guide element 72 the piston stroke of the first member 4 is guided by or actuated by the transfer of the distance from the rotor axis of guide face 73 over the outer face 9 of the second member and over the member 6 of the second body to the bearing bed 10 and thereby to the first body or piston 4.

The arrangement of these figures is generally known from FIGS. 1 to 3 of this application. The referentials are respectively the same and those referential numbers which are already described at FIGS. 1 to 3 do not require a further description here. The slight difference to FIGS. 1 to 3 is, that this embodiment of FIGS. 19 to 23 has only two crescent shaped recesses 1 with walls of radii around the fourth axis 88 and only a single medial recess. This recess has in these figures no referential number, because it is formed by the passages 18 and 8 in the first body or piston 4 and in the second body or piston shoe 5 or pivot member 6 thereof. Respectively, these figures show two sealing lands or sealing portions 3 and a common medial bearing land or bearing portion 2. The figures also show in separated views of portions of the first and second body the bearing bed 10 with face 31 and the face 32 of the pivotable member 6. Also shown are the second and third axes 71 of the first and second bodies 4 and 6. The axial ends of the member 6 are shown as formed by the third radius 84 to form part-cylindrical end faces 89. The substantially crescent shaped recesses or fluid pressure pockets 1 are visible between the walls 86 and 87 thereof, which are formed as tapered, convex or concave faces or walls with radii around the fourth axis 88.

The fluid under pressure is passed from the respective cylinder 96 in rotor 95 through passage 18 into the recesses 1,8 and into the outer face fluid pressure pockets 7.

Figure 25:
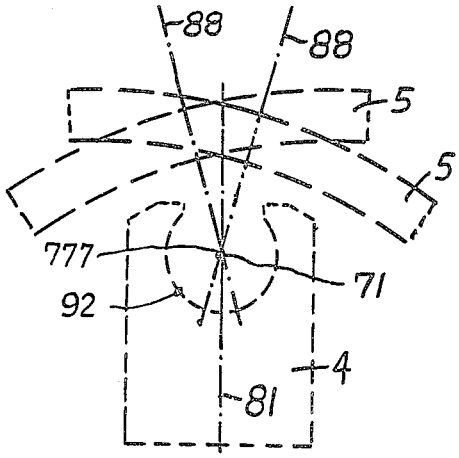
FIG. 25 is also a schematic.
Figure 24:
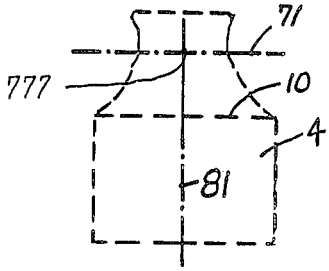
FIG. 24 is a schematic.

FIGS. 24 and 25 are schematics, wherein the outer shapes of the first and second bodies of the FIGS. 1 to 3 or of FIGS. 15 to 23 are shown by dotted lines. Explanied in these figures is, that the first body or piston 4 has a first axis 81 and a second axis 71 normal to the first axis 81. In FIG. 25 the fourth axis 88, which is the medial axis of the plane of pivotion 29, is shown in the two outer extremes of angles of pivotion. The outer portion 5 of the psiston shoe or second body is sketched in these extreme positions by dotted lines. FIG. 25 clearly demonstrates, that the fourth axis 88 swings through the first axis 81, when it pivotes and the fourth axis 88, the first axis 81 and the second axis 71 are at all times meeting in the centre 777 of pivotion.

Figure 28:
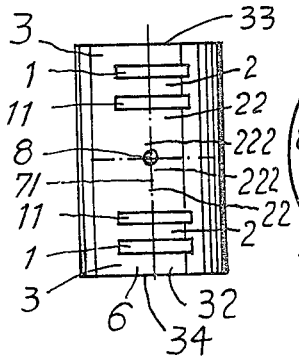
FIG. 28 is a view from arrow: 37 E" onto a portion of FIG. 26.
Figure 27:
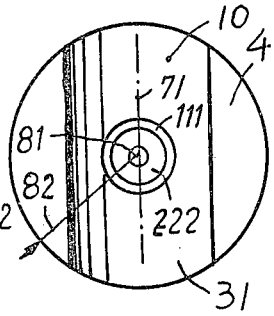
FIG. 27 is a view from arrow: "F" onto a portion of FIG. 26.
Figure 26:
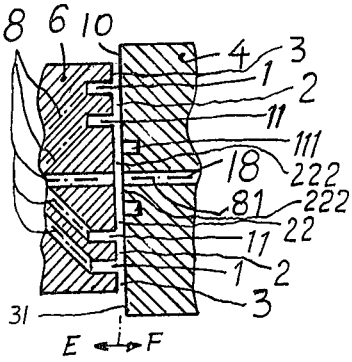
FIG. 26 is a longitudinal sectional view through a portion of an embodiment of the invention.

FIGS. 26 to 28 show an embodiment of the invention, wherein more than three recesses and more than one bearing land or bearing portion are provided. This embodiment also demonstrates, that the recesses may be provided either in the member 6 of the second body 5 or in the bearing bed 10 of the first body 4.

Thus, the member 6 of the second body has planer axial ends 33 and 44 and a first pair of recesses 1 parallel to said ends and distanced therefrom to form therebetween the outer sealing lands or sealing portions 2. Farther distanced from said ends 33 and 34 are further recesses provided, which form a second pair of recesses 11. These recesses are also parallel to the mentioned ends 33 and 34 and thereby parallel to the first pair of recesses 1. Between the recesses 1 and 11 are the bearing portions 2 provided and form a pair of bearing portions 2. Farther distanced from the mentioned ends 33 and 34 is an annular recess 111 provided in the first body 4 to meet the bearing bed 10 and the bed face 32. Between the mentioned recess 111 and the pair of recesses 11 are the bearing portions 22 provided. The first body 4 has further the medial passage 18 and the second body has the medial passage 8, whereby both passages 8 and 18 are meeting and form the medial recess 8,18. Between this medial recess 8,18 and the annular recess 111 is the bearing portion 222 provided. The other referential numbers of these figures are already known from their discussion of others of the figures.

Generally, when a means, arrangement or provision of the specification is discussed in one of the figures, the discussion of the equivalent part in other figures is occasionally spared.

The study of the former art has shown, that very different expressions and terminologies are used, because the aims of the former art are often different, even, when the figures look similar. Further, there are simple descriptions in the former art, which are easily understood even by the laymen, while otherwise the descriptions are in more advanced terminologies of geometry and technology. This present specification deals therefore with both styles of description and terminologies.

A short description, understandable also for the laymen, might define the invention as follows:

An arrangement of two bodies, including a first body 4 provided with a bearing bed 10, which coincides with a bearing bed face 31 of part-cylindrical configuration, wherein said arrangement of two bodies includes a second body 5 which forms a part-cylindrical pivot member 6, which is pivotably borne on said bed 10 of said first body 4, while said pivot member of said second body has axially relatively to its axis of pivotion a front end 33 and a rear end 34, wherein at least two fluid pressure containing recesses 1 are provided substantially parallel to said ends of said member of said second body, wherein said recesses 1 are distanced inwardly from said ends 33,34, of said member to form outer sealing portions 3 between the respective recess of said recesses and the respective end of said ends, and, wherein at least one bearing portion 2 is provided between at least two of said recesses, whereby the said bearing portion(s) is (are) subjected to fluid under pressure from the respective recesses on both axial ends of said bearing portion(s).

While a more geometrically defined decription of the invention might define the invention as follows:

An assembly of at least two bodies including a first body 4,304 and a second body 5,6, with said bodies being pressed together under a load;

wherein said first body has a first axis 81 and a second axis 71;

wherein said second axis is normal to said first axis and extending through said first axis and through said first body;

wherein said second body includes a n at least partially cylindrical member 6, wherein said second body has a third axis 71, coinciding with said second axis of said first body;

wherein said member extends around said third axis;

wherein said first body has an at least partially cylindrical outcut 10 for the reception of said member of said second body;

wherein said member and said outcut have faces 31,32, formed by substantially equal first radii 83 around said second and third axes and wherein one of said faces forms a bearing bed in said first body while the other of said faces forms a bearing face 32 on said member of said second body;

wherein said member is borne in said outcut and said load is acting in a direction substantially parallel to said first axis and normal to said second and third axes;

wherein said member of said second body is able to move in said outcut of said first body and around said second and third axes;

wherein said bearing face 32 slides along said bearing bed 10 and bed face 31, when said member moves in said outcut relatively to said first body;

wherein at least two recesses 1,11,111, are provided in at least one of said bodies and connected to said bearing bed and to said bearing face;

wherein said recesses constitute fluid pressure pockets;

wherein at least one fluid pressure passage 8,18, extends through at least one of said bodies to said recesses;

wherein at least one portion 2,22 of said bed and at least one portion of said face are located between said recesses and lubricated from both ends by fluid from said at least two recesses;

wherein said portions include straight lines 30 and adjacend face-portions extending substantially normal to the direction of said load of one of said bodies relatively to the other of said bodies, wherein said recesses are distanced from said first axis in a direction parallel to said second and third axes and wherein at least two of said recesses are substantially parallel to the axial ends 33,34,89 of said member 6.

I claim:

1. An arrangement of two bodies, including a first body provided with a bearing bed which coincides with a bearing bed face of part-cylindrical configuration, wherein said arrangement of two bodies includes a second body which forms a part-cylindrical pivot member which is pivotably borne on said bed face of said first body, while said pivot member of said second body has axially relatively to its axis of pivotion a front end and a rear end;

wherein at least two fluid pressure containing recesses are provided substantially parallel to said ends of said member of said second body, wherein said recesses are distanced inwardly from said ends of said member to form outer sealing portions between the respective recess of said recesses and the respective end of said ends, and, wherein at least one bearing portion is provided between at least two of said recesses, whereby the said at least one bearing portion is subjected to said fluid pressure from the respective recesses on both axial ends of said at least one bearing portion.

2. The arrangement of claim 1, wherein said ends are formed by part-cylindrical faces and at least two of said at least two recesses are substantially crescent shaped.

3. The arrangement of claim 2, wherein more than two recesses are provided and include in addition to at least two crescent shaped recesses at least one substantially annular medial recess to form a plurality of said bearing portions between said recesses.

4. An arrangement of two bodies, including a first body which has a longitudinal first axis and is provided with a bearing bed which coincides with a bearing bed face which is formed by a first radius around a second axis with said second axis normal to said first axis, whereby said bearing bed with said bearing bed face forms a bearing bed of part-cylindrical configuration, wherein said arrangement of two bodies includes a second body which forms a part-cylindrical pivot member by a first radius around a third axis which substantially coincides with said second axis of said first body while said pivot member of said second body has axially relatively to said third axis a front end and a rear end, wherein at least two fluid pressure containing recesses are provided substantially parallel to said ends of said member of said second body, wherein said recesses are distanced inwardly from said ends of said member to form outer sealing portions between the respective recess of said recesses and the respective end of said ends, and, wherein at least one bearing portion is provided between at least two of said recesses, whereby the said at least one bearing portion is subjected to fluid under pressure from the respective recesses on both axial ends of said at least one bearing portion.

5. The arrangement of claim 4, wherein said ends are formed by part-cylindrical faces and at least two of said at least two recesses are substantially crescent shaped.

6. The arrangement of claim 5, wherein more than two recesses are provided and include in addition to at least two crescent shaped recesses at least one substantially annular medial recess to form a plurality of said bearing portions between said recesses.

7. An assembly of at least two bodies including a first body and a second body with said bodies being pressed together under a load;

wherein said first body has a first axis and a second axis;

wherein said second axis is normal to said first axis and extending through said first axis and through said first body;

wherein said second body includes a n at least partially cylindrical member;

wherein said second body has a third axis coinciding with said second axis of said first body;

wherein said member extends around said third axis;

wherein said first body has an at least partially cylindrical outcut for the reception of said member of said second body;

wherein said member and said outcut have faces formed by substantially equal first radii around said second and third axes and wherein one of said faces forms a bearing bed in said first body while the other of said faces forms a bearing face on said member of said second body;

wherein said member is borne in said outcut and said load is acting in a direction substantially parallel to said first axis and normal to said second and third axes;

wherein said member of said second body is able to move in said outcut of said first body and around said second and third axes;

wherein said bearing face slides along said bearing bed when said member moves in said outcut relatively to said first body;

wherein at least two recesses are provided in at least one of said bodies and connected to said bearing bed and to said bearing face;

wherein said recesses constitute fluid pressure pockets;

wherein at least one fluid pressure passage extends through at least one of said bodies to said recesses;

wherein at least one portion of said bed and at least one portion of said face are located between said recesses and lubricated from both ends by fluid from said at least two recesses;

wherein said portions include straight lines and adjacent face-portions extending substantially normal to the direction of said load of one of said bodies relatively to the other of said bodies, wherein said recesses are distanced from said first axis, elongated in a direction parallel to said second and third axes, and, wherein at least two of said recesses are substantially parallel to the axial ends of said member.

8. An assembly of at least two bodies including a first body and a second body with said bodies being pressed together under a load;

wherein said first body has a first axis and a second axis;

wherein said second axis is normal to said first axis and extending through said first axis and through said first body;

wherein said second body includes an at least partially cylindrical member;

wherein said second body has a third axis coinciding with said second axis of said first body;

wherein said member extends around said third axis;

wherein said first body has an at least partially cylindrical outcut for the reception of said member of said second body;

wherein said member and said outcut have faces formed by substantially equal first radii around said second and third axes and wherein one of said faces forms a bearing bed in said first body while the other of said faces forms a bearing face on said member of said second body;

wherein said member is borne in said outcut and said load is acting in a direction substantially parallel to said first axis and normal to said second and third axes;

wherein said member of said second body is able to pivot in said outcut of said first body and around said second and third axes;

wherein said bearing face slides along said bearing bed when said member pivots in said outcut relatively to said first body;

wherein said second body has a fourth axis normal to said second and third axes and through said first axis;

wherein said fourth axis swings through said first axis when said member pivots relatively to said outcut while said second body pivots relatively to said first body;

wherein said first body has a second radius around said first axis to define a cylindrical outer face of said first body wherein said member has two ends and said ends are formed by a third radius;

wherein said third radius is shorter than said second radius;

wherein said third radius and said ends are formed around said fourth axis;

wherein at least two recesses are provided in at least one of said bodies and connected to said bearing bed and to said bearing face;

wherein said recesses constitute fluid pressure pockets;

wherein at least one fluid pressure passage extends through at least one of said bodies to said recesses;

wherein at least one portion of said bed and at least one portion of said face are located between said recesses and lubricated from both ends by fluid from said at least two recesses;

wherein said portions include straight lines and adjacent face-portions extending substantially normal to the direction of said load, and, wherein at least two of said recesses are substantially crescent-shaped and include surfaces which are substantially formed by archs of radii around said fourth axis;

whereby said atleast two recesses are substantially parallel to the axial ends of said atleast partially cylindrical member of said second body.

9. The assembly of claim 8, wherein said second body is a piston shoe and said first body is a piston of a radial piston machine.

10. An assembly of claim 8, wherein a plurality of fluid pressure pocket recess-portions are provided symmetrically of a central fluid pressure recess.

11. An assembly of claim 8, wherein said fluid pressure recesses are of at least part-circular configuration.

12. An assembly of claim 8, wherein a plurality of passage means are provided, at least one to each of said fluid pressure pocket recesses.

13. An assembly of claim 8, wherein said fluid pressure pocket recesses are provided in a pivot-bar portion of a piston shoe.

14. An assembly of claim 8, wherein at least two sealing end portions are provided outwards of said recesses and wherein at least two bearing portions are provided between said recesses on at least one of said bodies.

15. An assembly of claim 14, wherein said sealing end portions and said bearing portions are contact faces and said recesses are fluid pressure balancing areas together with said sealing end portions and bearing portions and wherein said bearing portions and said end portions are of more than thirty percent of the cross-sectional are of said first body and wherein said fluid pressure balancing areas are of a cross-sectional area of more than sixty percent of the cross-sectional area of said first body.

16. An assembly of claim 9, wherein flow through restriction means are provided in said passage in said piston.

* * * * *